United States Patent [19]

Patteri

[11] 4,027,341

[45] June 7, 1977

[54] JUNCTURE ARRANGEMENT BETWEEN THE BOW OF A HEARING PROTECTION MEANS AND A PROTECTIVE HELMET

[75] Inventor: Matti Patteri, Vantaa, Finland

[73] Assignee: Exel OY, Helsinki, Finland

[22] Filed: Feb. 12, 1976

[21] Appl. No.: 657,699

[30] Foreign Application Priority Data

Feb. 14, 1975 Finland ..... 750410

[52] U.S. Cl. ..... 2/423; 2/209; 179/156 R

[51] Int. Cl.[2] ..... A42B 3/00

[58] Field of Search ..... 2/209, 3 R, 6, 423; 179/156 R

[56] References Cited

UNITED STATES PATENTS

| | | | |
|---|---|---|---|
| 1,812,114 | 6/1931 | Nolke | 179/156 R |
| 3,430,261 | 3/1969 | Benner | 2/3 R |
| 3,721,993 | 3/1973 | Lonnstedt | 2/209 X |
| 3,795,919 | 3/1974 | Aho | 2/6 |

FOREIGN PATENTS OR APPLICATIONS

| | | | |
|---|---|---|---|
| 723,955 | 8/1942 | Germany | 179/156 R |

*Primary Examiner*—Werner H. Schroeder
*Assistant Examiner*—Peter Nerbun

[57] ABSTRACT

A device for protecting the hearing of a user which includes an ear hood secured to a helmet by a pivotable bow which can be moved forwardly and rearwardly of the helmet and also laterally thereof. The bow is provided with a sliding surface over which a pin slides when the ear hood is moved outwardly. A spring member is connected at one end to the helmet and at the other end to the slidable pin for normally holding the ear hood against the ear. When the ear hood is moved laterally from the ear of the user the pin slides over the sliding surface so that the spring member urges the bow to remain in its outward position.

4 Claims, 5 Drawing Figures

JUNCTURE ARRANGEMENT BETWEEN THE BOW OF A HEARING PROTECTION MEANS AND A PROTECTIVE HELMET

The present invention concerns a juncture arrangement between the bow of a hearing protection means and a protective helmet, comprising a fixing part turnably attached to the helmet, this fixing part allowing the ear hood to be turned forwardly and backwardly, and to which the bow of the ear hood has been attached turnably in such manner that it may be turned outwardly in lateral direction, this turning being effected against the force of a spring.

It is common practice in juncture arrangements of the type mentioned known in prior art to form the spring counteracting the turning motion of the ear hood in lateral direction in that the fixing bow of the ear hood consists of a spring material and the upper end of the bow has been shaped to be a cylindrical or helical spring with its axis parallel to the turning axis of the bow. For one thing, the manufacturing of such a spring of special design is a costly operation, and secondly it imposes certain restrictions on the material of which the bow of the ear hood is made.

The object of the invention is to provide an improved juncture arrangement of the type mentioned wherein the spring counteracting the turning of the bow may be a conventional spiral spring and wherein the material of the bow is freely selectable, for instance the bow may be made of plastic material.

This object of the invention is mainly accomplished in that the spring is a tension or compression spring, one end of which has been attached to the fixing part and the other end braced by means of a sliding piece against a sliding surface provided on the bow and/or turning along with the bow and which has a direction such that when the ear hood is turned laterally between its extreme positions the sliding piece slides along the sliding surface so that the straight line connecting the points of attack of the spring shifts from one side to the other of the bow's turning axis.

It is thus understood that hereby a juncture arrangement capable of all requisite actions is obtained in a structurally exceedingly simple manner.

In an advantageous embodiment of the invention the spring is a spiral spring, one end of which has been affixed to the fixing part by means of a screw screwed into the spring. The first advantage gained hereby is easy assembly of the unit, because tightening of the spring simultaneously affixes the bow and the fixing part to each other, and the tightening of the spring can be accomplished with minor force. Secondly, the screw may also be used during use of the arrangement to adjust the pressure with which the ear hood is urged against the user's head.

In an advantageous embodiment of the invention there is between the fixing part and the protective helmet, a washer having on its margins eminences met by a cam on the, forwardly or backwardly and partly sidewardly turned, bow of the ear hood so that the ear hood when turned into the position mentioned is slightly raised from the surface of the helmet. This arrangement is made possible in the present invention expressly by the circumstance that the end of the bow no longer needs to operate in the capacity of spring and whereby it has been possible to provide on the end of the bow, consisting e.g. of plastic material, a cam which keeps the ear hood in the said position of rest. This serves to avoid the soiling of the ear hood's sealing pad, which is placed against the user's skin, from the surface of the helmet or its damage by abrasion against the helmet.

The invention is more closely described in the following with reference to the attached drawings, wherein:

FIG. 1 presents a sectional view of the juncture arrangement of the invention.

Figure 1:
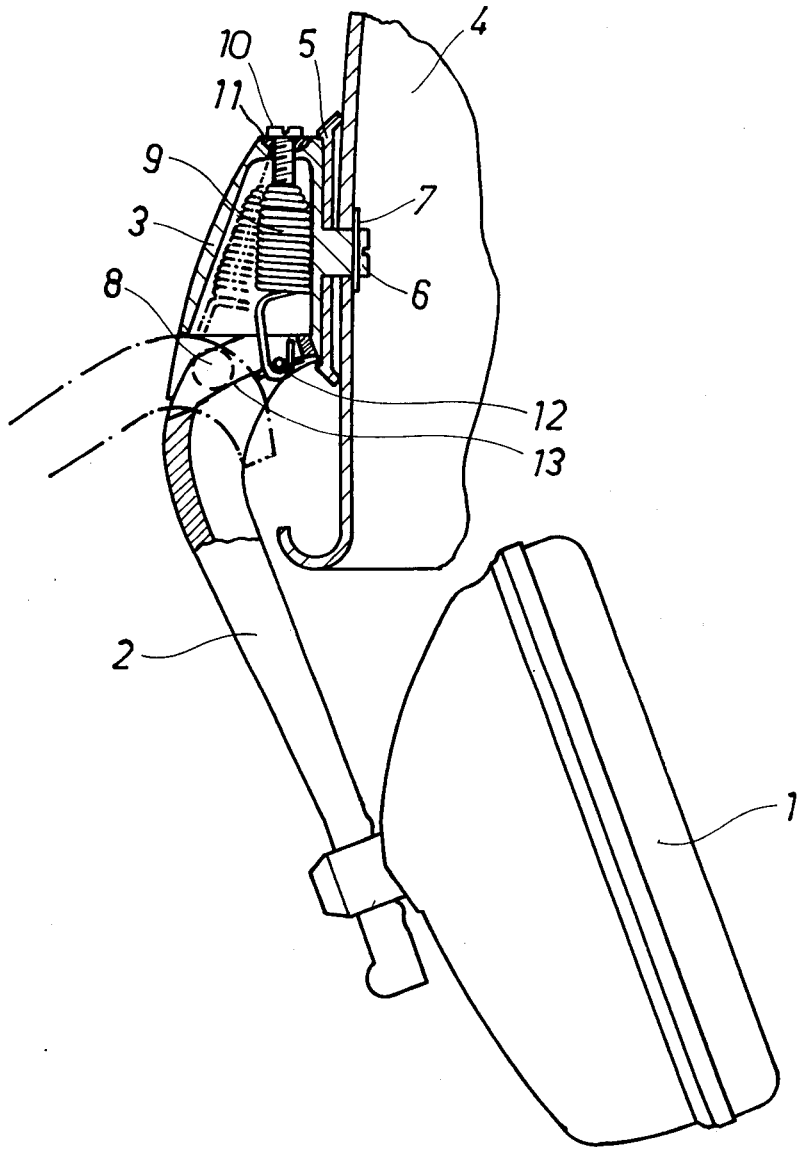

The ear hood 1 joins the helmet 4 by mediation of the bow 2 and the fixing part 3. The fixing part 3 lies upon the washer plate 5, and the pivot pin 6 of the fixing part passes through a hole in the helmet and has been secured on the inside with the aid of a locking ring 7. The fixing part 3 is turnable about the pivot pin 6, whereby the ear hood 1 may be turned forwardly and backwardly.

The bow 2 has been attached to the fixing part 3 by means of the pin 8, whereby the bow and the ear hood 1 may also be turned laterally.

In order that the ear hood 1 might be urged with a suitable pressure against the user's head and so that it might also be held in its extreme sidewise turned position, the invention features a spiral spring 9, one end of this spring being attached to the fixing part 3 by means of a screw 10 screwed into the spring 9. The head of the screw 10 rests upon a rocking piece 11 permitting the turning motion of the screw, and which rocking piece has a cylindrical surface. The fixing part 3 has a depression 11*a* with the shape of part of a cylinder to receive the rocking piece 11. The other end of the spring 9 attaches to the sliding piece 12, which is able to slide along the sliding surface 13 on the bow 2. The direction of the sliding surface 13 has been chosen so that when the bow 2 is turned to the side through a given distance the sliding piece 12 moves, pulled by the spring 9, to the other end of the sliding surface 13. When furthermore the length of the sliding surface 13 has been chosen so that the line connecting the points of attachment 10 and 12 of the spring 9 is then displaced to be on the other side of the axis 8, then the bow 2 will remain in its sidewise turned position, which has been indicated with dotted lines in FIG. 1.

Figure 4:
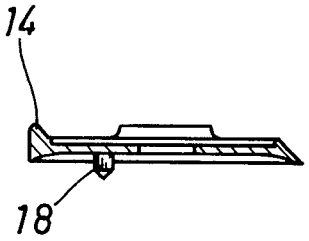
FIG. 4 shows the washer plate belonging to the juncture arrangement, representing the section along the line V—V in FIG. 5.
Figure 5:
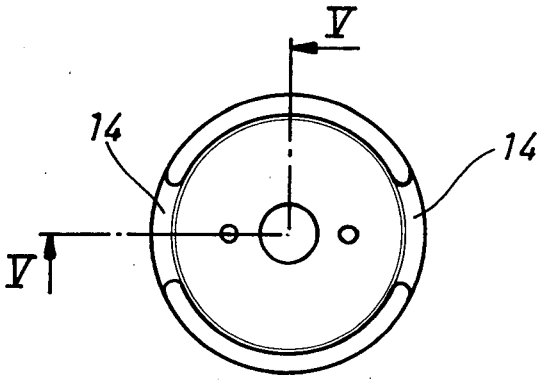
FIG. 5 shows the washer plate in top view.

Between the fixing piece 3 and the helmet the washer plate visible in FIGS. 4 and 5 has been interposed. This plate is unturnably fixed to the helmet by means of the pin 18 and a corresponding hole in the helmet. The washer plate 5 has on its margin, in front and in the rear, eminences 14, and the bow 2 carries on its end a cam 15, these details being so dimensioned that when the ear hood is forwardly or backwardly turned and somewhat raised to the side the cam 15 will ride on the eminence 14 so that the ear hood 1 is kept slightly raised from the surface of the helmet.

The components of the juncture arrangement of the invention, that is the bow 2, fixing part 3 and washer plate 5, may all be manufactured at low cost as plastic pressings. The spring 9 is a conventional spiral spring.

Figure 2:
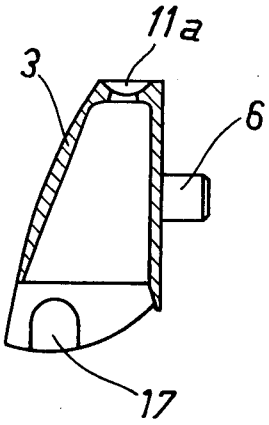
FIG. 2 shows a sectional view of the fixing part belonging to the juncture arrangement.
Figure 3:
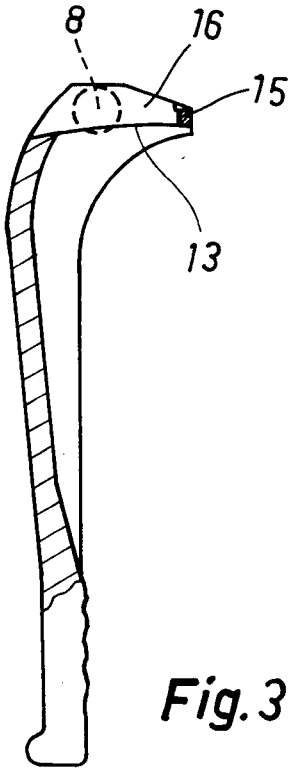
FIG. 3 is a longitudinal section of the bow belonging to the juncture arrangement.

The components are easy to assemble in that the end of the spring 9 is passed through the slit 16 on the end of the bow and the end of the spring is passed around the sliding piece 12. The end of the bow 2 is then placed in the fixing part 3 so that the axle pins 8 enter the journal depressions 17 of the fixing part 3 (FIGS. 2 and 3). The screw 10 is then screwed into the spring 9, whereby the loose parts are tightened up. The screw 10 may moreover be employed during service, as an adjustment screw to control the pressure of the ear hood 1 against the user's head.

I claim:

1. A hearing protection device comprising a protective helmet to be worn by the user of the device, an ear hood, an elongated bow member connecting said ear hood to said protective helmet, a fixing part, a first pivot means provided on said fixing part for pivotally securing said protective helmet for forward and rearward pivotal movement with respect thereto, a second pivot means provided on said fixing part, the upper end of said bow member being mounted on said pivot means to provide lateral movement of said ear hood toward and away from the ear of the user, the upper end of said bow member being provided with an elongated sliding surface extending at a substantial angle to the principal axis of said bow member, a resilient member secured at one end to said fixing part, a pin mounted on the other end of said resilient member for sliding engagement on the sliding surface of said bow member, whereby when said bow member is pivoted laterally away from the ear of the user, the angle of the sliding surface of said bow member alters with respect to said resilient member causing said pin, under force of said resilient member, to slide over said sliding surface, said pivot means being located between the ends of the sliding surface so that said pin moves from one side to the other of said pivot means and said bow member is resiliently urged to its outer lateral position.

2. A device as claimed in claim 1 wherein said resilient member comprises a coil spring.

3. A device as claimed in claim 2 and further comprising a screw pivotally mounted on said fixing part to pivot about an axis parallel to the axis of said second pivot means, the one end of said coil spring being secured to said screw.

4. A device as claimed in claim 1 and further comprising a washer member fixed to said protective helmet and provided with segmental protuberances about its periphery and mounted between said protective helmet and said fixing part, the upper end of said bow member engaging said protuberances when said bow member is moved forwardly or rearwardly with respect to said helmet to move said ear hood slightly laterally from the ear of the user.

* * * * *